United States Patent [19]

Larsen

[11] Patent Number: 4,575,906

[45] Date of Patent: Mar. 18, 1986

[54] HOOK FASTENING DEVICE

[76] Inventor: Walter L. Larsen, P.O. Box 18302, Seattle, Wash. 98118

[21] Appl. No.: 28,850

[22] Filed: Apr. 10, 1979

[51] Int. Cl.[4] ..... A44B 13/02; A41D 27/22

[52] U.S. Cl. ..... 24/238; 24/231; 223/85; 248/340; 403/207; 403/397

[58] Field of Search ..... 24/230.5 R, 231, 238, 24/241 SP; 223/85; 403/397, 207, 209; 248/340, 305, 306

[56] References Cited

U.S. PATENT DOCUMENTS 2,122,309 6/1938 Beimler ..... 24/230.5 R 4,034,902 7/1977 Grillo ..... 223/85

FOREIGN PATENT DOCUMENTS 1500741 11/1967 France ..... 223/85

*Primary Examiner*—Alexander Grosz

[57] ABSTRACT

This invention pertains primarily to supplementary fastening devices in the form of a loop shaped clip in which the length of the loop portion of the clip is extensible and which are adapted for fastening the hook of a garment hanger or other hook including device to a clothesline or other linear member to which the hook is hooked.

66 Claims, 47 Drawing Figures

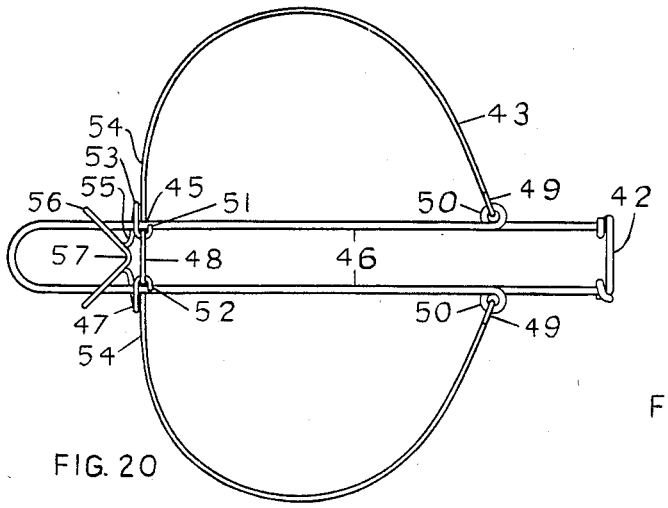
FIG. 20
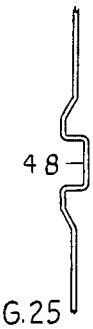
FIG. 25
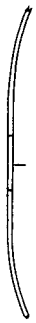
FIG. 24
FIG. 26
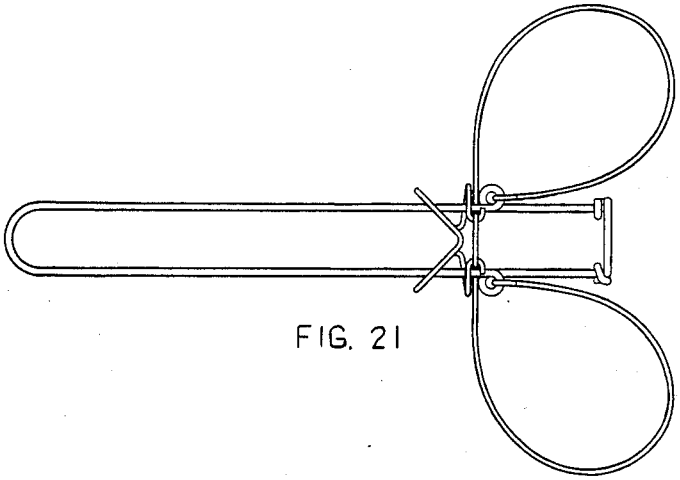
FIG. 21
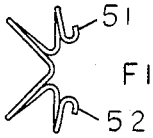
FIG. 27
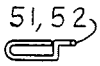
FIG. 28
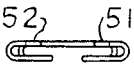
FIG. 29
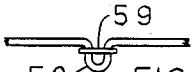
FIG. 30
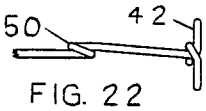
FIG. 22
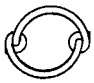
FIG. 23
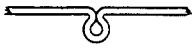
FIG. 31
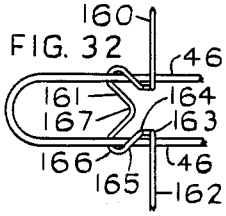
FIG. 32
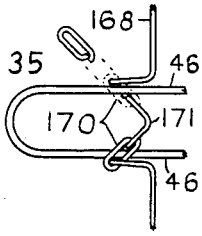
FIG. 35
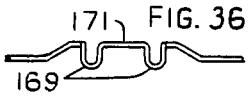
FIG. 36
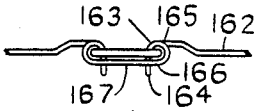
FIG. 33
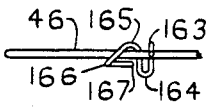
FIG. 34
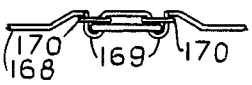
FIG. 37
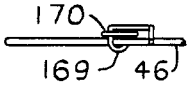
FIG. 38

HOOK FASTENING DEVICE

TECHNICAL FIELD

This invention relates primarily to supplementary fastening devices for securing the hook of a garment hanger or other hook including device or similarly curved member including device to a generally linear member such as a clothesline, cable, rod or the like to which the hook is attached by being hooked to the linear member. It also relates to a device for fastening an object to a linear member, said device being comprised of the combination of a hook and a supplementary fastening device. It further relates to a spring device which provides a non-linear force-displacement relationship and which has general applicability to devices, including the fastening device herein described, which can utilize such a spring device. Finally, it relates to methods for fastening a hook to a linear member.

BACKGROUND ART

A bendable loop-type hook fastening device made of resilient material which is capable of fastening a hook to a clothesline or other linear member is set forth in French Pat. No. 1.500.741 issued to Jacob. A semi rigid loop-type clip adapted to close the hook opening of a standard wire clothes hanger when that hook has substantially parallel sections is described in U.S. Pat. No. 2,122,309 issued to Beimler. Other attempts to solve the problem of fastening a hook to a linear member have resulted in devices which attach to the linear member and then, in turn, suspend the hook to the device itself. Examples of devices in this category are U.S. Pat. Nos. 2,092,121; 2,915,274; and 3,184,204. There have also been devices which replace or modify the garment hanger hook in order to more positively fasten the garment hanger to the clothesline of which the following U.S. Patents are examples: Nos. 1,690,614; 3,048,311; 3,240,462 and 4,034,902. Other patented devices might, with some modification, be adapted to fasten a hook to a linear member as, for example, those described in U.S. Pat. Nos. 265,171, 825,332; 1,274,280 and 2,360,164.

DISCLOSURE OF INVENTION

There has long been a need for a fastening device which could effectively fasten a garment hanger or other hook including device to a clothesline or other generally linear member. In the case of garment hangers, they are commonly used for holding various items of clothing while they dry after being washed. When suspended from a clothesline, garment hangers are often blown by the wind along the clothesline. When the clothesline has appreciable sag, all of the suspended garment hangers will usually bunch together at the center of lowest position on the clothesline and thereby retard the drying. In gusty winds, suspended garment hangers are often blown off the clothesline.

Some of the previous attempts to resolve these problems have involved modifications to, or replacement of, the hook of the garment hanger. In some cases this has resulted in a device which could be suspended from a clothesline but which could not be satisfactorily suspended from a larger diameter support. Nearly always, such devices resulted in higher product cost. Other attempts have involved devices which attach to the clothesline and then, in turn, suspend the garment hanger hook from the device itself. These devices appear to be costly and/or ineffectual at retaining the hook in suspension under adverse conditions.

To alleviate problems such as the foregoing. this invention provides a supplementary fastening device for securing the hook of a garment hanger or other hook including device to a clothesline or other linear member after the hook has already been hooked to the linear member in the normal manner. This invention accomplishes this by providing an effectively closed loop of material which passes over the hook of the garment hanger or other hook including device at two locations, one on each side of the clothesline or other linear member and which passes under the clothesline or linear member at two locations, one on each side of the suspended hook. This fastening device thus acts to lock the attached hook to the clothesline or other linear member. The fastening device may be a simple loop of material resembling a somewhat elongated link of a chain, it may be provided with a handle, it may have provisions for effectively elongating the loop to facilitate installation and removal of the fastening device as well as to improve its effectiveness in clamping the hook to a linear member or it may have a loop which is open or which can be opened to improve the ease of installing and removing the device.

It is therefore an object of the present invention to provide a supplementary fastening device for fastening the hook of a garment hanger or other hook or similarly curved member including device to a clothesline or other generally linear member to which the hook is attached by being hooked to the linear member.

It is also an object of this invention to provide a fastening device, for securing a hook or curved member to a generally linear member, which is inexpensive to manufacture and easy to use.

Another object of this invention is to provide a fastening device which will tend to prevent a hook, which is hooked to a linear member, from being unintentionally unhooked from the linear member.

A further object of this invention is to provide a device which will tend to prevent a hook, which is hooked to a linear member, from being displaced along the direction of the linear member.

Another object of this invention is to provide a device for fastening an object to a linear member, said device being comprised of the combination of a hook and a supplementary fastening device.

It is also an object of this invention to provide methods for fastening a hook to a linear member.

An additional object of this invention is to provide a spring device which has a non-linear force-displacement relationship for applications, including the fastening device herein described, in which it is necessary or desirable to have non-linear return forces or to avoid high return forces at the upper range of spring displacement.

Other objects and advantages and a fuller understanding of the invention may be had by referring to the detailed description hereinafter presented, taken in conjunction with the drawings forming a part hereof, wherein like numerals refer to like parts throughout.

BRIEF DESCRIPTION OF DRAWINGS

In the drawings:

FIG. 20 is a plan view of the elongatable loop fastening device with a generally C-shaped spring provided with thumb and finger rests, the movable loop end being in the position in which the spring is at rest.

FIG. 21 is a plan view of the device shown in FIG. 20 with the movable loop end being in the position of maximum effective length of the loop of said device.

FIG. 22 is a fragmentary side elevational view of the thumb rest end of the loop body of the device shown in FIG. 20.

FIG. 23 is an end view of the thumb rest shown in FIG. 22.

FIG. 24 is a fragmentary plan view of that portion of the generally C-shaped spring which crosses the loop body of the device shown in FIG. 20.

FIG. 25 is a fragmentary end view, as viewed from the left side, of that portion of the C-shaped shown in FIG. 24.

FIG. 26 is a fragmentary end view, as viewed from the right side, of that portion of the generally C-shaped spring which pivotally attaches to the loop body of the device shown in FIG. 20.

FIG. 27 is a plan view of the spring loaded clip of the device shown in FIGS. 20 and 21, said clip being shown in its unloaded state.

FIG. 28 is a side elevational view of the spring loaded clip shown in FIG. 27.

FIG. 29 is an end view of the spring loaded clip shown in FIGS. 27 and 28.

FIG. 30 is a fragmentary plan view of an alternative pivot attachment means on a side member of the loop body of the device shown in FIGS. 20 and 21, said attachment means comprising a U-shaped bend and a clip.

FIG. 31 is a fragmentary plan view of a second alternative pivot attachment means on a side member of the loop body of the device shown in FIGS. 20 and 21, said attachment means comprising a somewhat U-shaped bend which is further bent so as to close the opening in the "U" to form an eye.

FIG. 32 is a fragmentary plan view of the fixed loop end of the loop body of the device shown in FIGS. 20 and 21 together with a fragmentary portion of an alternative configuration of the C-shaped spring and movable loop end wherein said spring and movable loop end are combined in one piece.

FIG. 33 is a fragmentary end view of that portion of the device shown in FIG. 32.

FIG. 34 is a fragmentary side elevational view of that portion of the device shown in FIGS. 32 and 33.

FIG. 35 is a fragmentary plan view of the fixed loop end of the loop body of the device shown in FIGS. 20 and 21 together with a fragmentary portion of an alternative configuration of the C-shaped spring and movable loop end wherein said spring and movable loop end are combined in one piece which is slideably attached to the side members of the loop body with clips, one unassembled clip being depicted above the principal figure.

FIG. 36 is a fragmentary end view of the combined C-shaped spring and movable loop end shown in FIG. 35 without the loop body or clips.

FIG. 37 is a fragmentary end view of that portion of the device shown in FIG. 35.

FIG. 38 is a fragmentary side elevational view of that portion of the device shown in FIGS. 35 and 37.

DESCRIPTION OF THE INVENTION

This invention is primarily a device in the form of a clip having an effectively closed loop which is adapted for fastening the hook of a garment hanger or other hook including device to a clothesline or other generally linear member to which the hook is attached by being hooked to the linear member in the normal manner.

Figure 1:
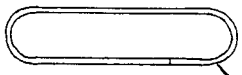
FIG. 1 is a plan view of the loop-type fastening device embodied in the shape of an elongated simple chain link.
Figure 2:
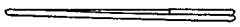
FIG. 2 is a side elevational view of the device shown in FIG. 1.
Figure 3:
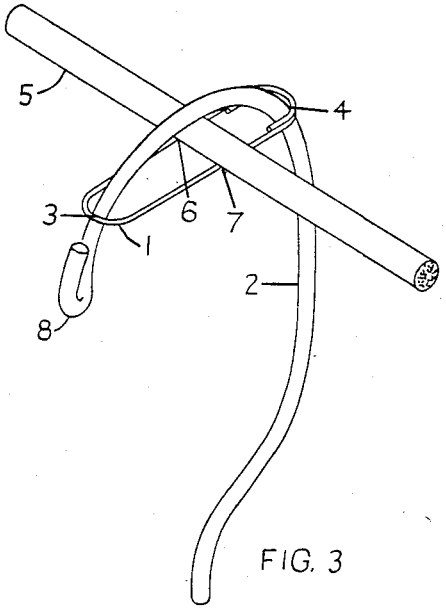
FIG. 3 is a perspective view of the device shown in FIGS. 1 and 2 fastening a garment hanger hook to a clothesline.

The simplest form of the loop-type fasteningg device appears in FIGS. 1 and 2 as a generally loop shaped clip which somewhat resembles the link of a chain. As depicted, it is made of wire, preferably spring wire, however a variety of materials having at least moderate resistance to deformation, such as metal rod and the more rigid types of plastics, could be used. The action of this fastening device in fastening a garment hanger hook to a clothesline is shown in FIG. 3. The fastening device loop, 1, bears down on the the hanger hook, 2, at two points, 3 and 4, and bears up on the clothesline, 5, at two points, 6 and 7, thus locking the hanger hook to the clothesline. Spring pressure resulting from elastic bending of the fastening device may be used to apply pressure at these points to create friction which will tend to prevent the hanger hook from sliding along the clothesline.

In the case of the type of hanger hook depicted in FIG. 3, the bent over end, 8, forms a retaining element which tends to prevent the fastening device, 1, from shifting position so as to slip off the end of the hook and thus fail in its fastening action. Most other hanger hooks which do not have such a bent-over end, including most of those made of metal and plastic, have the corresponding end of the hook straightened out, or at least having less curvature than the curved upper portion. This region of reduced or no curvature also acts as a retaining element which tends to prevent the fastening device from shifting position so as to slip off the end of the hanger hook. It accomplishes this by introducing a force which tends to bend or elongate the loop as the fastening device moves closer to the end of the hanger hook. The reaction of this force is a force which tends to move the loop away from the end of the hanger hook.

One method of installing this fastening device is as follows. Slip the end of the hanger hook through the loop of the fastening device so that the rod, 2, of which the hook is formed is passing into and through the loop of the fastening device and allow the fastening device to rest at the base of the hanger hook. Then suspend the hanger hook from the clothesline in the normal manner as in FIG. 3. Then grasp one end of the fastening device, pulling it under the clothesline, 5, and toward the end, 8, of the hanger hook. Then push the end, 8, of the hanger hook through the end of the loop, at 3, of the fastening device and move the fastening device into the approximate position shown in FIG. 3.

The simple form of the fastening device depicted in FIGS. 1 through 3 demonstrates the basic principle upon which this invention operates. It provides an effectively closed loop of material which follows a closed circuit path around the combination of the clothesline and the suspended hanger hook in such a manner as to positively lock them together. It should be noted, however, that this device would work just as well if the loop was openable or even if it had a permanently open section provided that insofar as it contacts or acts upon the combination of the clothesline and the suspended hook, the effect was the same as though the loop followed a closed circuit path around the combination. Some of the modifications of this fastening device hereinafter presented make use of such openable or open sections in the loop.

Figure 4:
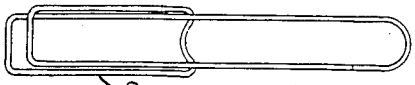
FIG. 4 is a plan view of the the fastening device comprised of a loop provided with a handle.
Figure 5:
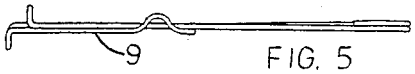
FIG. 5 is a side elevational view of the device shown in FIG. 4 and it may also serve as a side elevational view of the device shown in FIG. 6.
Figure 6:
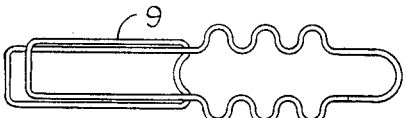
FIG. 6 is a plan view of the fastening device provided with means for increasing the flexibility of the loop.

The simple loop device of FIGS. 1 through 3 can be modified to improve its ease of application as well as its effectiveness in holding the hanger hook to the clothesline. In FIGS. 4 and 5, the fastening device has a hand hold, 9, at one end of its loop to make the device easier to install and remove. The fastening device shown in FIG. 6 is further modified in that its loop portion is provided with circuitous bends, 10, which increases the flexibility and effectively allows the loop portion of the clip to be elastically extended in length which will allow it to accomodate a wider range of clothesline and hanger hook sizes. Thus rendering the loop effectively elastically extensible also facilitates installation of the device and tends to improve its frictional holding ability. Such bends can be in a variety of shapes including coils and the wave-like pattern shown. The loops of the fastening devices shown in FIGS. 1 through 6 appear straight in the side views but, in their unloaded state, the sides of the loops may be curved upward or downward in order to best function with any particular size of clothesline or hanger hook.

There are other ways of providing the fastening device with means for allowing the effective length of the loop portion of the clip to be extended. One way this can be accomplished is by having one end of the loop fixed with respect to the main body of the clip and the other end movable along the length of the loop body. The device may be provided with an elastic force producing member which generally urges a reduction in the extension of the effective length of the loop. With such an arrangement, it becomes much easier to install and remove the fastening device, a much larger range of clothesline and hanger hook sizes can be accomodated, and the device has a more positive fastening action.

Figure 7:
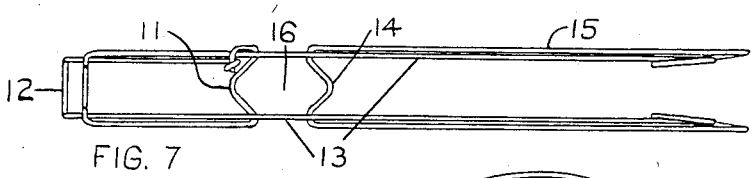
FIG. 7 is a plan view of the fastening device with means for elongating the loop portion thereof against a force provided by a spring formed from extensions of the loop body.
Figure 8:
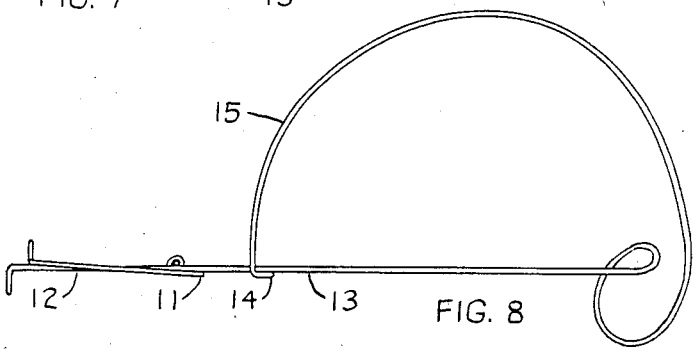
FIG. 8 is a side elevational view of the device shown in FIG. 7.

One form of the fastening device having such an effectively extensible loop is shown in FIGS. 7 and 8. Here the fixed loop end, 11, which may be provided with a handle, 12, is not movable with respect to the side members, 13, of the loop body, while the movable loop end, 14, can be moved to the right along the side members, 13, and against the force of the spring, 15, to increase the effective length of the loop. This fastening device, as embodied in FIGS. 7 and 8, is made of spring wire and has the movable loop end, 14, the spring, 15, and the side members, 13, of the loop body formed of one piece of material. The fixed loop end, 11, and the movable loop end, 14, may have detents as shown which tend to keep hanger hooks, especially those constructed of thinner wire, aligned with the longitudinal axis of the loop body. This fastening device can be applied by first tipping it upside down relative to the position shown in FIG. 8, passing the end of the hanger hook through the inner region of the loop, 16, and allowing the device to rest at the base of the hanger hook. Then, after the hanger hook has been suspended from a clothesline, the handle, 12, can be grasped and moved so as to pull it under the clothesline toward the end of the hanger hook, thus forcing the loop to be elongated against the force of the spring, then, once again, passing the end of the hanger hook through the inner region of the loop, 16, and finally raising the fastening device into a position such that the clip generally contacts the outer surface of the hook at two points and the loop lies between these two points on a path which passes generally on the side of the linear member which is opposite to the side closest to the hook.

Figure 9:
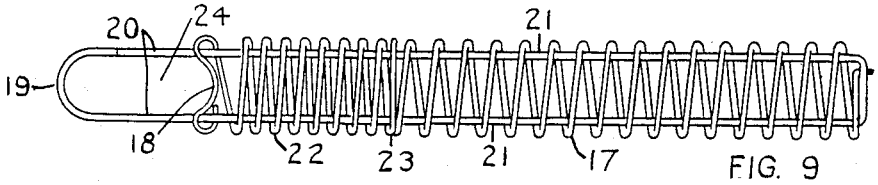
FIG. 9 is a plan view of the fastening device with means for elongating the loop portion thereof against a force provided by a helical spring.
Figure 10:
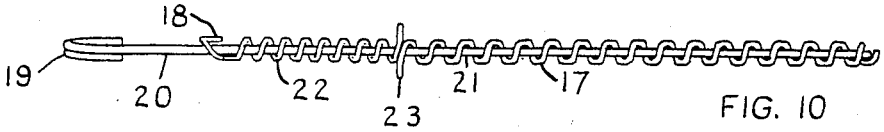
FIG. 10 is a side elevational view of the device shown in FIG. 9.

FIGS. 9 and 10 show a fastening device provided with a helical type spring, 17, which acts and is slideable along the side members, 20 and 21, of the loop body. This allows the movable loop end, 18, to move back and forth along the side members to increase or decrease the effective length of the loop. The effective length of the loop is that distance and portion of the loop which lies between the fixed loop end, 19, and the movable loop end, 18, and is thus a variable quantity depending on the position of the movable loop end. The loop body is that portion of the fastening device which generally includes the fixed loop end and the side members. The side members, which are generally parallel, are comprised of the sides, 20, of the loop, which is that variable portion of the side members lying within the effective lenght of the loop, and the side extensions, 21, of the loop, which is that variable portion of the side members extending beyond the effective length of the loop.

In the device shown in FIGS. 9 and 10, that portion, 22, of the helical type spring nearest the movable loop end is shaped so that it can be grasped by the fingers and thereby be used as a hand hold in manipulating the device. There may be a raised portion, 23, in the spring to assist in preventing the fingers from slipping along the spring. This fastening device can be used in a manner similar to the above described method for using the device shown in FIGS. 7 and 8 as follows. After inserting the hanger hook into the inner region of the loop, 24, and suspending the hanger hook from the clothesline, pull and hand hold, 22, on the spring to elongate the loop and then maneuver the fastening device into a position corresponding generally with that shown in FIG. 3.

Figure 11:
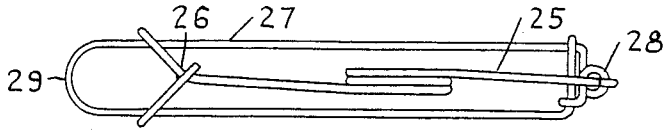
FIG. 11 is a plan view of the fastening device with means for elongating the loop portion thereof against a force provided by a two-legged spring.
Figure 12:
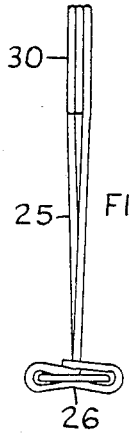
FIG. 12 is an end view of the device shown in FIG. 11.
Figure 13:
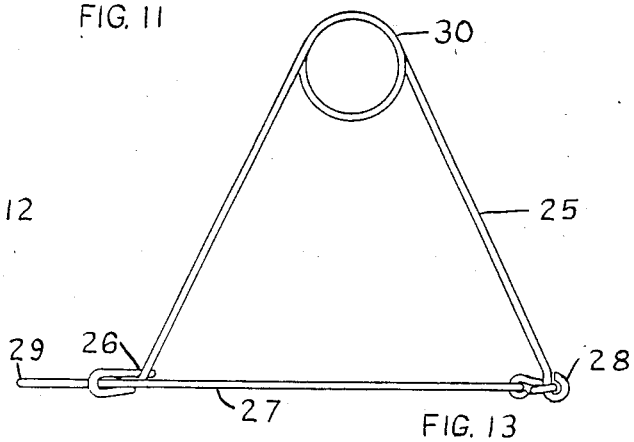
FIG. 13 is a side elevational view of the device shown in FIGS. 11 and 12.

FIGS. 11 through 13 show a loop type fastening device provided with a two-legged spring, 25, which urges the movable loop end, 26, toward a position of minimum effective length of the loop. As shown in the drawings, one end of the spring acts upon the loop body, 27, at a pivoted connection, 28, which is opposite to the fixed loop end, 29, of the loop body and the other end of the spring acts upon the movable loop end, 26, of the loop body. Coils, 30, may be incorporated in the spring as shown to increase its flexibility although they may not be required. The movable loop end, 26, may be formed of an extension of the material of which the spring is made as shown. This fastening device may be conveniently manipulated by grasping the legs of the spring, 25, between the thumb and the fingers and squeezing them together to open the loop. When held in this manner this device may easily be manuevered into a fastening position on the clothesline and suspended hanger hook corresponding generally with that shown in FIG. 3.

Figure 14:
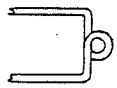
FIG. 14 is a fragmentary plan view of an alternative spring attachment end of the loop body of the device shown in FIG. 11.

In FIG. 11, the ends of the wire forming the loop body, 27, are at the end, 28, of the loop body at which the two legged spring is pivotally connected to the loop body. FIG. 14 shows an arrangement of that end of the loop body in which the ends of the wire which form the loop body are at the fixed loop end of the loop body in cases, as for example, when it is desired to have an openable section at the fixed loop end of the loop body.

Figure 16:
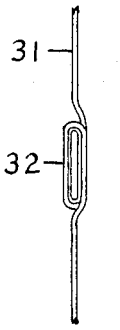
FIG. 16 is a fragmentary end view of a portion of the C-shaped spring and loop body of the device shown in FIG. 15.
Figure 15:
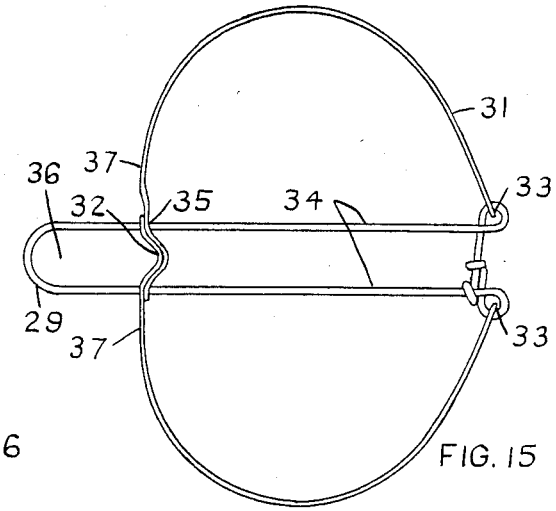
FIG. 15 is a plan view of the fastening device with means for elongating the loop portion thereof against a force provided by a generally C-shaped spring.

FIGS. 15 and 16 depict a fastening device using a generally C-shaped spring, 31, to urge the movable loop end, 32, toward a position of minimum effective length of the loop. This spring is pivotally connected to the loop body at two pivot locations, 33, which are at the end of the loop body opposite to the fixed loop end, 29. In addition to being pivotally connected to the loop body at the ends of the spring, this spring must be free to slide along the side members, 34, of the loop body at the location, 35, where the center section of the spring crosses the side members. In the configuration depicted in FIGS. 15 and 16, the spring is slidably connected to the side members at this crosssing location, 35, by having the wire of which the spring is made wrapped around the side members to form a slot shaped loop, at 32, which can slide along the side members and which, in this case, also forms and serves as the movable loop end, 32.

This fastening device can be used by inserting the end of a hanger hook through the inner region of the loop, 36, and allowing the device to rest at the base of the hanger hook. Then, after the hanger hook has been suspended from the clothesline, the fastening device can be grasped with one hand by placing one finger on each side of the loop body on the finger rests, 37, on the C-shaped spring near the crossing location, 35, and then pulling to bend the spring and move the movable loop end, 32, toward the pivot locations, 33, thereby elongating the loop. With the loop thus elongated and positioned below the clothesline, the fastening device can be raised so that the end of the hanger hook passes through the inner region of the loop, 36, allowing the device to be further raised and released in a fastening position corresponding generally with that shown in FIG. 3.

Figure 17:
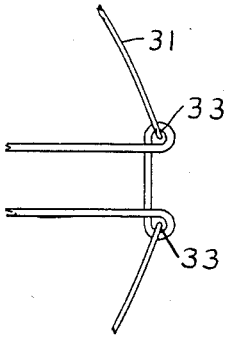
FIG. 17 is a fragmentary plan view of an alternative spring attachment end of the loop body of the device shown in FIG. 15.

FIG. 17 shows a modified arrangment of the end of the loop body containing the pivot locations, 33, for the generally C-shaped spring, 31, when it is desired to have the ends of the wire forming the loop body at the fixed loop end for purposes such as having an openable section in the loop at the fixed loop end.

Figure 19:
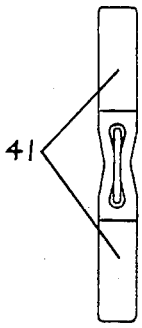
FIG. 19 is an end view of the device shown in FIG. 18.
Figure 18:
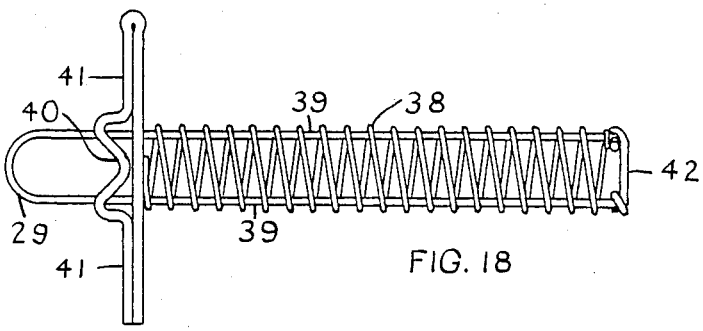
FIG. 18 is a plan view of the elongatable loop fastening device with a helical spring provided with thumb and finger rests to facilitate manipulation.

The fastening device shown in FIGS. 18 and 19 makes use of a helical type spring, 38, acting along the side members, 39, of the loop body. In this case the movable loop end, 40, is connected to a finger rest means, 41, and the end of the loop body opposite to the fixed loop end, 29, has a second finger rest means, 42. The finger rest means connected to the movable loop end most conveniently serves as finger rests, 41, for two fingers and the second finger rest means at the end of the loop body serves as a thumb rest, 42, thereby allowing this fastening device to be held with one hand and manipulated in manner analogous to the manner of holding and manipulating a hypodermic syringe. Thus by holding this device in that manner and squeezing the thumb rest, 42, toward the two finger rests, 41, the movable loop end, 40, will slide along the side members, while compressing the spring, 38, in a direction away from the fixed loop end, 29, with the result that the loop will be effectively increased in length. Then, while being held in this manner with the loop elongated, this device can be easily installed on a hanger hook already suspended from a clothesline by reaching over the suspended hook with the end of the hook pointing away from the person, passing the end of the hook through the loop of the fastening device, pulling the fastening device toward the person so that the fixed loop end, 29, of the device passes between the hook and the clothesline (under the hook but over the clothesline), then moving the fastening device so that the fixed loop end, 29, moves under the clothesline toward the end of the hanger hook, and finally passing the end of the hanger hook through the loop, once again, and raising and releasing the fastening device in a position corresponding generally with that shown in FIG. 3.

The best mode contemplated for carrying out this invention is depicted in FIG. 20. In this mode the device utilizes a generally C-shaped spring, 43, as does the device shown and described with reference to FIGS. 15 and 16. It also has finger rests, 54, which are part of the C-shaped spring, and a thumb rest, 42, which is similar to the thumb rest on the device shown in FIGS. 18 and 19, thus allowing the device depicted in FIG. 20 to be held and manipulated in a manner analogous to the manner of holding and manipulating a hypodermic syringe. When this drive is so held and the finger rests, 54, are squeezed toward the thumb rest, 42, the loop portion of the fastening device is elongated and the C-shaped spring becomes bent as shown in FIG. 21. While the loop is thus elongated, this device can be manuevered and installed in a fastening position in generally the same manner as described with reference to the device shown in FIGS. 18 and 19. FIGS. 22 and 23 are additional views of the thumb rest of the device shown in FIG. 20 and show how the ends of the wire forming the loop body can be bent to form the thumb rest, 42.

FIGS. 24 and 25 show details of the center section of the C-shaped spring at the location, 45, where it crosses the side membes, 46, of the loop body in FIG. 20. As depicted, this fastening device uses a spring loaded clip, 47, to slidably attach the C-shaped spring, 43, to the side members, 46, at this crossing location, 45. In this case the wire in the center section of the C-shaped spring is bent so that it forms a generally square cornered raised section, 48, which protrudes between the side members, 46, and is capable of being locked in place by the spring loaded clip, 47.

The end of the C-shaped spring, which are bent in small eyelet loops, 49, for pivotal connection to the side members, 46, of the loop body at the pivotal connection points, 50, are shown, in end view, in FIG. 26. The pivotal connection points, 50, on the loop body are, in this case, formed as small eyelet loops, 50, in the wire of the side members as shown in FIGS. 20 and 22.

The spring loaded clip, in its unattached and unloaded state, is shown in three views in FIGS. 27 through 29. This clip has two outward opening and outwardly biased hooks, 51 and 52, which hook to the raised section, 48, of the C-shaped spring, 43, and slidably lock it to the side members, 46, of the loop body as shown in FIG. 20. When assembled in the fastening device, the wire of the spring loaded clip extends outward from one of its hooks, 51, past the side member on its side to a position, 53, outboard of the side member. Then the wire is bent in a generally reverse direction so as to extend inward and to pass by the opposite side of the same side member. Then, before reaching the middle of the loop body, the wire is bent generally outward again, at 55, and then is bent generally around the outside of the same side member, at 56, and then the wire extends inward to the center and on the same side of the loop body as the hooks, 51 and 52, are located where it may be formed into a V-shaped detent, 57. Then the wire continues across to the other side member where it is bent around that side member, as shown, in generally the same manner as being bent around the first side member and the wire then terminates at the second hook, 52, in the spring loaded clip. This clip may also serve as the movable loop end, and the V-shaped detent, 57, is for the purpose of assisting in keeping the hanger hook aligned with the longitudinal axis of the loop body.

The C-shaped spring, 43, used in this fastening device has a unique advantage in that the force which it provides at the crossing location, 45, to urge the movable loop end toward a position of minimum effective length of the loop, as shown in FIG. 20, becomes substantially less at the position of maximum deflection and maximum effective length of the loop, as shown in FIG. 21, than would be the case with a spring, such as the helical type spring, 38, of the device in FIG. 18, in which the force-displacement relationship is essentially linear. This allows the person using the fastening device with the C-shaped spring to hold it in the position of maximum length of the loop, FIG. 21, with less exertion during installation and removal of the device in its fastening position that would otherwise be required. The amount of this reduction in force at maximum deflection is determined to some extent by the shape of the C-shaped spring. An increase in the degree of curvature in that portion of the spring which is closer to the crossing location, 45 (FIG. 20), than to the ends of the spring wire, 49, generally causes a further reduction in the force at maximum deflection of the C-shaped spring.

FIGS. 30 and 31 show alternative methods of forming pivotal connection points on the side members of the loop body to that shown (at 50) in FIG. 20. In FIG. 30, a U-shaped bend, 58, is formed in the side member and a small loop-shaped clip, 59, is positioned over the U-shaped bend, 58, to form an eyelet loop for pivotally connecting the C-shaped spring, 43, to the loop body. In FIG. 31, a generally U-shaped bend is closed at the top of the "U" to form the eyelet loop for the same purpose.

An alternative method for slidably connecting the C-shaped spring, 160, to the side members, 46, of the loop body is shown in three views in FIGS. 32 through 34. In this method, the movable loop end, 161, is formed of the same piece of wire forming the C-shaped spring. As can be seen in the drawings, the wire, 162, leading toward the side of the loop body, first crosses the nearest side member and then is bent around that side member into and through the plane of the loop body, at 163, then, after extending a short distance in that direction, is bent in a reverse direction, at 164, so as to pass again through the plane of the loop, then is bent around the outside of the side member, at 165, and continues around until it reaches a point, at 166, on the opposite side of the side member from the side on which it initially crossed the side member, and then the wire extends inward toward the center of the loop region where it may be formed into a V-shaped detent, 167, for the purpose of assisting in aligning the fastened hanger hook with the longitudinal axis of the loop. Then the wire continues toward the other side member where it is bent around that side member, as shown, in a similar manner to being bent around the first side member.

The above described method for connecting the spring to the side members, which is shown in FIGS. 32 through 34 can be modified by having the wire, 162, leading toward the side of the loop body continue generally straight after crossing the nearest side member until it reaches a point generally somewhat less than halfway between the side members, and then having the wire bent in a generally reverse direction so as to recross the same side member and then be bent around the outside of that side member, at 165, and then continue to be bent generally as described above with reference to FIGS. 32 through 34.

A further method for slidably connecting the C-shaped spring, 168, to the side members, 46, of the loop body is shown in various views in FIGS. 35 through 38. In this case, the C-shaped spring, 168, is bent so as to include two U-shaped bends, 169, which accomodate the side members, 46. Two generally loop shaped clips, 170, are then positioned at the top of the U-shaped bends, 169, as shown to slidably lock the C-shaped spring, 168, to the side members. The movable loop end, 171, can also be incorporated as part of the C-shaped spring as shown.

Figure 39:
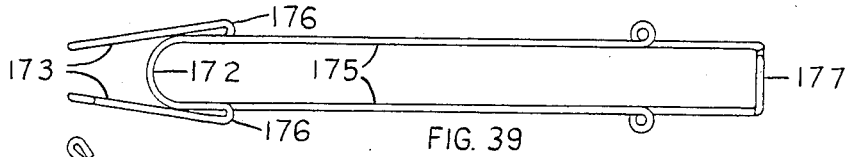
FIG. 39 is a plan view of the loop body portion of a fastening device similar to that shown in FIG. 20, wherein said loop body has an openable section at the location of the effectively closed fixed loop end.
Figure 40:
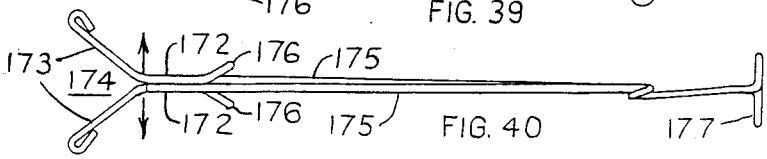
FIG. 40 is a side elevational view of the loop body shown in FIG. 39.

A modified form of loop body which improves the ease of installing and removing the fastening device in its fastening position, and which can be directly substituted for the loop body in the device of FIGS. 20 and 21, is shown in FIGS. 39 and 40. Here the fixed loop end of the loop body is formed of two overlapping segments, 172, to create an openable section in the loop. These overlapping segments, which are normally held together by spring pressure from the loop body, can be separated in the directions indicated by the arrows to open the fixed loop end of the loop body and thereby allow the stem of a hanger hook to be inserted directly into the inner region of the loop without first passing the end of the hook through the loop as is necessary in the other devices so far described. These two mutually separable segments, 172, comprise an effectively closed openable section in the loop, located, in this case, in the effectively closed fixed loop end of the loop, which allows this fastening device to be just as effective for fastening the hook of a hanger to a clothesline as those devices in which there is no openable section. Each overlapping segment, 172, may be provided with a structure, 173, which extends away from the fixed loop end of the loop body at an angle, as shown in FIG. 40, and which provides a ramped entry region, 174, at the end of the loop body. Thus it can be seen that if the fastening device is moved so that the stem of a hanger hook enters the ramped entry region, 174, with the stem approximately in or parallel to the plane of the loop body, the device can then be pushed toward and against the stem causing it to react with these ramped entry structures, 173, forcing the overlapping segments, 172, apart, and thereby allowing the device to be further moved in the same direction until the stem of the hanger hook enters into the inner region of the loop. In performing this operation, the fastening device is, of course, held so that the movable loop end is in a position of maximum effective length of the loop corresponding to the position shown in FIG. 21. After the stem of the hook is within the inner region of the loop, the fastening device can then be tilted approximately 90 degrees so that the plane of the loop body is approximately parallel with the clothesline and the device can then be raised, passing the end of the hanger hook through the loop region, and released in a fastening position corresponding generally with that shown in FIG. 3.

The modified loop body of FIGS. 39 and 40 also permits the fastening device to be removed from its fastening position and directly separated from the hanger hook without slipping the loop body off the end of the hanger hook. In removing this fastening device, the loop is first elongated to correspond with the situation as shown in FIG. 21, the fastening device is lowered so that only the stem of the hanger hook remains within the inner region of the loop, and then the device is generally tilted about 90 degrees so that the stem of the hook contacts the side members, 175, and forces the overlapping segments, 172, to separate, thus opening the loop. Then the fastening device can simply be pulled back so that the stem of the hanger hook passes out of the opened section of the loop. It can be seen that each overlapping segment, 172, without the ramped entry region structure, 173, forms a generally J-shaped structure with the side member being the straight part of the "J". That part of each overlapping segment corresponding with the end of the curved part of the "J", 176, can be bent away at an angle from the plane of the loop body, as shown in FIG. 40, to form a ramped exit region to facilitate withdrawing the stem of the hanger hook from the inner region of the loop.

Figure 41:
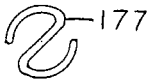
FIG. 41 is an end view of the thumb rest of the loop body shown in FIGS. 39 and 40.
Figure 42:
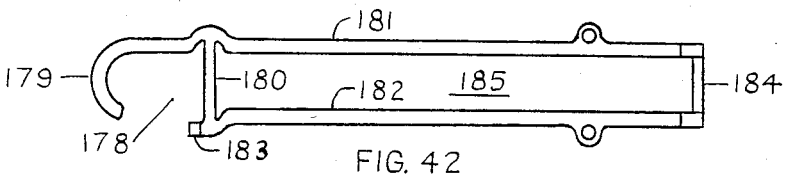
FIG. 42 is a plan view of the loop body portion of a fastening device similar to that shown in FIG. 20 wherein said loop body has an open section in a portion of the loop near, and to one side of, the fixed loop end.

Having an openable section at the fixed loop end of the loop body, as in FIGS. 39 and 40, generally requires that the ends of the wire or other material forming the loop body be at that end of the loop body. In this case the thumb rest, 177, at the other end of the loop body can be formed by bending and curving the wire between the side members, 175, as shown in FIGS. 39 through 41.

Figure 44:
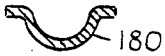
FIG. 44 is a view of the section at the plane indicated by the line 44—44 of FIG. 43.
Figure 43:
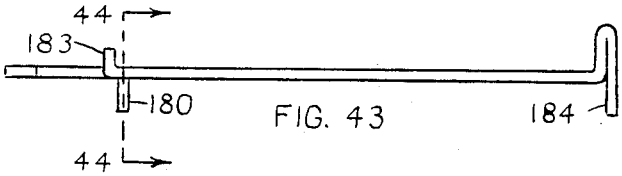
FIG. 43 is a side elevational view of the loop body shown in FIG. 42.
Figure 45:
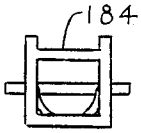
FIG. 45 is an end view of the loop body shown in FIG. 43.

Instead of having an openable section in the loop, there may be a permanently open section in order to facilitate installation and removal of the fastening device. It should be noted, however, that even though there may be such an open section in the loop, the result is still that of an effectively closed loop insofar as the fastening device contacts or acts upon the combination of the clothesline and suspended hanger hook. One configuration of a loop body with an open section is shown in FIGS. 42 through 45. Here the open section, 178, is located to one side of the fixed loop end, 179. There is a structural support member, 180, connecting the two side members, 181 and 182, near the open section, 178, to provide strength and stiffness for the side member, 182, which is on the same side of the loop body as the open section, 178. This support member, 180, may be curved downward, as shown in FIG. 44, to provide clearance with the suspended hanger hook. There may also be a short projection, 183, at or near the end of the side member, 182, which is on the same side as the open section, 178, in order to prevent the clothesline from slipping off that side member, 182, and into the open section, 178. This loop body may generally be used with a C-shaped spring and movable loop end of a type similar to those described previously. It may also be modified as necessary to function with other types of springs such as helical and two legged springs. As shown in FIGS. 42 through 45, this loop body is made from a stamping of sheet metal although other methods of fabrication can be used. These drawings show how the thumb rest, 184, can be made from this material.

A fastening device with the loop body shown in FIGS. 42 through 45 can be used by first having the end of a hanger hook, which is suspended from a clothesline, pointing toward the person using the fastening device. After elongating the loop, as described with reference to FIGS. 20 and 21, the device is moved so that the stem of the hanger hook enters the open section, 178, and into the inner region of the loop near the fixed loop end, 179. Then the fastening device is simply raised so that the end of the hanger hook passes through the inner region of the loop, 185, without the open section, and released in a fastening position corresponding generally with that shown in FIG. 3.

Figure 46:
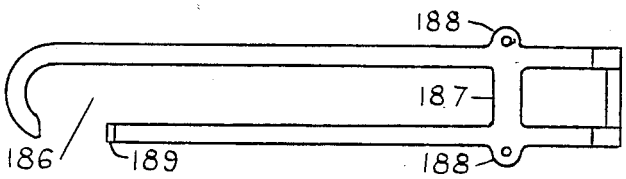
FIG. 46 is a plan view of the loop body portion of a fastening device similar to that shown in FIG. 42 wherein the open section is open to the entire effective length of the loop.
Figure 47:
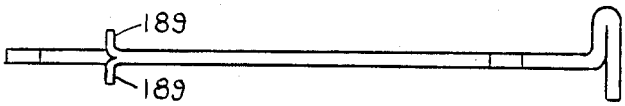
FIG. 47 is a side elevational view of the loop body shown in FIG. 46.

The loop body may also have an open section, 186, without a structural support member near the open section as shown in FIGS. 46 and 47. In this case some additional stiffness may be provided for the structure by having a support member, 187, between the side members at or near the pivotal connection points, 188, for the C-shaped spring. Additional stiffness may also be furnished by having thicker material in the loop body. Projections, 189, may be provided on the side member next to the open section as limit stops for the movable loop end and to prevent the clothesline from slipping off the side member and into the open section, 186. In addition to being usable with a C-shaped spring, this loop body may also be modified for use with other types of springs. A fastening device with the loop body shown in FIGS. 46 and 47 is used in a generally similar manner to a device described with reference to FIGS. 42 through 45 except that the hanger need not be oriented in any particular direction.

The foregoing is considered as illustrative only of the principles of the invention. Further, since numerous modifications and changes will readily occur to those skilled in the art, it is not intended to limit the invention to the exact construction and operation shown and described, and accordingly all suitable modifications and equivalents may be resorted to, falling within the scope of the invention as claimed.

What is claimed is:

1. A fastening device for fastening a hook to a generally linear member comprising an effectively closed generally loop shaped clip in which the effective length of the loop portion of the clip is extensible and which is so constructed and arranged that it is adapted to occupy a position with respect to the hook and the linear member, when the hook is hooked to the linear member, such that the clip generally contacts the outside surface of the hook at two points, one generally on each side of the position occupied by the linear member, and the loop lies between said two points on a path which generally passes on the side of the linear member which is opposite to the side closest to the inner surface of the hook.

2. The fastening device of claim 1 wherein the generally loop shaped clip has an elastic force producing member which generally urges a reduction in the extension of the effective length of the loop.

3. The fastening device of claim 1 or 2 wherein the clip is so constructed, arranged and sized that it is adapted to occupy a positively interlocking position with respect to the hook and the linear member, when the hook is hooked to the linear member, such that the clip bears upon and is positively supported by the generally curved upper surface of the hook at two spaced-apart points, one on each side of the linear member, and the clip also lies between said two support points on a path which generally passes on the side of the linear member which is opposite to the side closest to the inner surface of the hook.

4. The fastening device of claim 2 wherein the elastic force producing member is a spring.

5. The fastening device of claim 2 comprising an effectively closed loop made of substantially rigid material having at least moderate resistance to deformation wherein said loop is so shaped that the loop is rendered effectively elastically extensible.

6. The fastening device of claim 2 comprising an effectively closed loop made of substantially rigid material having at least moderate resistance to deformation wherein said loop has circuitous bends in the loop path which render the loop effectively elastically extensible.

7. The fastening device of claim 2 comprised of a loop body having side members forming the sides and side extensions of the loop, an effectively closed fixed loop end which is generally fixed with respect to the side members of the loop body, a movable loop end which is generally movable with respect to the side members of the loop body to increase or decrease the effective length of the loop, the elastic force producing member generally acting on the loop body and the movable loop end to urge these elements in the direction of decreasing the effective length of the loop.

8. The fastening device of claim 7 comprising an effectively closed loop made of material having at least moderate resistance to deformation wherein said loop is comprised of a loop body having generally parallel side members forming the sides and side extensions of the loop and an effectively closed fixed loop end, a movable loop end which is movable generally along the side members of the loop body to increase or decrease the effective length of the loop, and a spring generally acting to urge the movable loop end in the direction of decreasing the effective length of the loop.

9. The fastening device of claim 7 wherein the loop body is made of wire.

10. The fastening device of claim 7 wherein said force producing member is a spring which is comprised of an extension of the material comprising the loop body.

11. The fastening device of claim 7 wherein the movable loop end is comprised of an extension of the material of which the spring including force producing member is made.

12. The fastening device of claim 2 wherein the force producing member is a generally helical type spring.

13. The fastening device of claim 7 wherein the force producing member is a generally helical type spring acting along the longitudinal direction of the loop body and located on the loop body on the side of the movable loop end other than the side facing the fixed loop end.

14. The fastening device of claim 2 wherein the force producing member is a two-legged spring acting on the fastening device at the ends of the legs.

15. The fastening device of claim 7 wherein the force producing member is a two-legged spring, the end of one leg acting on the loop body at a location on said loop body that is generally somewhat more distant from the fixed loop end than the movable loop end at the position of said movable loop end which provides the maximum effective length of the loop, the end of the other leg acting on the movable loop end.

16. The fastening device of claim 15 wherein the movable loop end is comprised of an extension of the material comprising the leg of the spring action on said movable loop end.

17. The fastening device of claim 7 wherein said force producing member is a generally and somewhat C-shaped spring lying generally and approximately in the plane of said loop body, the ends of said spring being pivotally attached to said loop body at pivot attachments which are located on said loop body at a generally somewhat greater distance from the fixed loop end than the movable loop end at the position of said movable loop end which provides the maximum effective length of the loop, said pivot attachments allowing angular motion of said spring in the vicinity of said pivot attachments in at least the plane of said loop body, said spring extending generally outward from each side of said loop body in the vicinity of said pivot attachments and then bending around so as to cross said side members of said loop body at a crossing location which is generally in the vicinity of said movable loop end, said spring being slideably attached to said side members at said crossing location in such manner as to allow said spring to slide along and in the direction of said side members, said spring acting on said movable loop end at said crossing location.

18. The spring as set forth in claim 17 being an element of a spring-including device, wherein said spring is so constructed and shaped that it provides a non linear force-displacement relationship, the force being lower in the high range of elastic displacement than indicated by a linear extrapolation of the force-displacement relationship in the initial range of displacement.

19. The spring of claim 18 so constructed and shaped that it provides a reduction in force in the maximum range of elastic displacement from the force provided at an intermediate range of displacement.

20. The spring of claim 17, being an element of a spring-including device, wherein said spring is made of wire.

21. The fastening device of claim 17 wherein the spring is so constructed and shaped that it provides a non linear force-displacement relationship, the force being lower in the high range of elastic displacement than indicated by a linear extrapolation of the force-displacement relationship in the initial range of displacement.

22. The fastening device of claim 21 wherein the spring is so constructed and shaped that it provides a reduction in force in the maximum range of elastic displacement from the force produced at an intermediate range of displacement.

23. The fastening device of claim 17 wherein the spring is made of wire.

24. The fastening device of claim 1 combined with a hand hold.

25. The fastening device of claim 7 combined with a hand hold.

26. The fastening device of claim 7 combined with a hand hold generally in the vicinity of the fixed loop end.

27. The fastening device of claim 13 having a hand hold on the spring generally in the vicinity of the movable loop end.

28. The fastening device of claim 7 having a first finger rest means generally connected with and acting on the movable loop end and a second finger rest means generally connected with and acting on the loop body at a position generally more distant from the fixed loop end than the first finger rest means.

29. The fastening device of claim 7 wherein the loop body has a thumb rest generally at the end opposite the fixed loop end and wherein there are finger rests primarily for two fingers, said finger rests being generally connected with and acting on the movable loop end and being disposed in a manner similar to the finger rests on a hypodermic syringe to enable the fastening device to be held and manipulated in a manner analogous to the manner of holding and manipulating a hypodermic syringe.

30. The fastening device of claim 29 wherein the loop body is made of wire with the ends of the wire being at the end of the loop body having the thumb rest and wherein the thumb rest is formed by having the wire at the thumb rest end of each side member bent at generally and approximately a right angle so as to lie generally in a plane perpendicular to the longitudinal axis of the loop body with the wire extending initially in a direction which is generally at an angle to a direction toward the opposite side member, the wire then being bent generally in a curve in that plane so as to follow a generally simple curved path around to said opposite side member, the end of the wire then being bent generally around the end of that side member so as to maintain its position with respect to that side member, the two ending sections of wire thereby forming a generally ring shaped closed loop in said plane perpendicular to the longitudinal axis of the loop body to serve as a thumb rest.

31. The fastening device of claim 29 wherein the loop body is made of wire with the ends of the wire being at the fixed loop end of the loop body and wherein the thumb rest is formed by having the wire at the thumb rest end of each side member bent at generally and approximately a right angle so as to lie generally in a plane perpendicular to the longitudinal axis of the loop body with the wire extending initially in a direction which is generally at an angle to the direction toward the opposite side member, the wire then being bent generally in curves lying generally in said plane perpendicular to the longitudinal axis of the loop body so as to reach said opposite side member with the wire generally being continuous throughout the thumb rest and side members.

32. The fastening device of claim 17 wherein the loop body has a thumb rest at the end opposite the fixed loop end and wherein those portions of the generally and somewhat C-shaped spring which extend outward from each side of the loop body at the crossing location of said spring with respect to the loop body are usable as finger rests, said finger rests together with the thumb rest enabling the fastening device to be held and manipulated in a manner analogous to the manner of holding and manipulating a hypodermic syringe.

33. The fastening device of claim 17 wherein the spring is a piece of spring wire which is slideably attached to the side members of the loop body at said crossing location by being bent entirely around the side members to form a slot through which the side members can slide, said spring being further bent so as to enter the region of said crossing location from one side of the loop body generally parallel and close to the plane of the loop body and to exit said region on the other side of the loop body in a generally similar manner.

34. The fastening device of claim 17 wherein the spring is slideably attached to the side members of the loop body at the crossing location by the combination with the side members of a spring loaded clip and the spring interlocked together at said crossing location.

35. The fastening device of claim 34 wherein the movable loop end is part of the spring loaded clip.

36. The fastening device of claim 34 wherein the spring is a piece of spring wire bent so as to enter the region of said crossing location generally from one side of the loop body generally parallel and close to the plane of the loop body, then crossing the first side member of the loop body and then being bent at a generally and approximately right angle around that side member into the loop and passing through the plane of the loop body on the inside of the loop close to the side member and continuing for a short distance in a direction generally normal to the plane of the loop body, then being bent at a generally and approximately right angle so as to prorceed therefrom in a direction generally parallel to the plane of the loop body toward the second side member of the loop body, then being bent at a generally and approximately right angle so as to pass through the plane of the loop body close to said second side member on the inside of the loop and then being bent at a generally and approximately right angle around said second side member and then continuing so as to exit the region of said crossing location generally away from the side of the loop body which is opposite to the side where it entered said region; and wherein the spring loaded clip has two outwardly biased hooks with outward facing openings, said hooks being hooked on the portions of the spring which are generally normal to the plane of the loop body and are on that side of the plane of the loop body at which the spring passes from the first side member toward the second side member of the loop body, the body of said spring loaded clip continuing outward from each hook and then around the outside of each side member to the other side of the plane of the loop body, then continuing generally inward past each side member, then being bent generally outward again and around the outside of each side member to the side of the plane of the loop body on which the hooks are hooked to the spring, then generally inward where the two described portions of the spring loading clip are united in continuity, thereby slideably attaching the spring to the side members of the loop body.

37. The fastening device of claim 17 wherein the spring is a piece of spring wire which is slideably attached to the side members of the loop body by said spring being bent so as to enter the region of said crossing location generally from one side of the loop body and generally parallel and close to the plane of the loop body, crossing the first side member and then being bent around that side member into the loop and through the plane of the loop body, then being bent in a generally reverse direction and coming through the loop and the plane of the loop body again, then being bent generally around the outside of said first side member and continuing around to the side of said first side member which is generally opposite to the side which the spring first crossed after entering said region, said spring wire then continuing generally across to the second side member and then continuing to be bent around and with respect to the second side member in a similar mirror image manner to being bent around the first side member, said spring wire then exiting said region generally away from the side of the loop body which is opposite to the side where it entered said region.

38. The fastening device of claim 17 wherein the spring forms the movable loop end at said crossing location.

39. The fastening device of claim 17 wherein the spring is a piece of spring wire which is slideably attached to the side members by said spring wire being bent so as to enter the region of said crossing location generally from one side of the loop body generally parallel and close to the plane of the loop body, crossing the first side member and then continuing generally in the same direction a distance generally somewhat less than one-half of the distance between the side members, then being bent in a generally reverse direction and continuing outward to cross said first side member on the same side as the initial crossing, then being bent generally around the outside of said first side member and then continuing around to the side of said first side member which is generally opposite to the side which the spring wire first crossed after entering said region, said spring wire then continuing generally across to the second side member and continuing to be bent around and with respect to the second side member in a similar mirror-image manner to being bent around the first side member, said spring wire then exiting said region generally away from the side of the loop body which is opposite to the side where it entered said region.

40. The fastening device of claim 17 wherein said spring is a piece of spring wire which is slideably attached to the side members of the loop body at said crossing location by being provided with two U-shaped bends, one at the location of crossing each side member, one said side member being positioned in the lower part of each U-shaped bend, there being a substantial bend in said spring wire at the top at each side of each U-shaped bend, each U-shaped bend being of sufficient depth to accomodate one side member plus a clip which is positioned around the upper part of each U-shaped bend to lock the side member within the lower part of the U-shaped bend, said bends at the top of each U-shaped bend functioning to retain its respective clip in its locking position.

41. The fastening device of claim 17 wherein the spring is a piece of spring wire and wherein the pivot attachments located on the loop body are substantially closed eyelet loops.

42. The fastening device of claim 17 wherein the spring is a piece of spring wire and the loop body is made of wire and wherein the pivot attachments located on the loop body are substantially closed eyelet loops formed by bending the wire of the loop body in a generally circular loop at each pivot attachment location.

43. The fastening device of claim 17 wherein the spring is a piece of spring wire and wherein the spring is pivotally attached to the side members of the loop body by a U-shaped bend in each side member combined with a clip which forms an eyelet for each attachment.

44. The fastening device of claim 17 wherein the spring is a piece of spring wire and the loop body is made of wire and wherein the spring is pivotally attached to the side members of the loop body by a U-shaped bend in each side member, said U-shaped bend being further bent so as to close the opening in the "U" and thus form an eyelet for each attachment.

45. The fastening device of claim 7 wherein the loop has an openable section which is adapted to allow the stem of the hook to enter directly into the inner region of the loop through the opened although normally effectively closed openable section.

46. The fastening device of claim 7 wherein the generally looped shaped clip has an openable section comprised of mutually separable segments, said openable section having an entry region which is so shaped that it causes said segments to spread apart when the fastening device is moved in a manner bringing the stem of the hook into said entry region, thereby opening the fixed loop end and allowing the stem of the hook to enter directly into the inner region of the loop.

47. The fastening device of claim 7 wherein the generally loop shaped clip has an openable section comprised of two overlapping segments with a generally ramped entry region which is so shaped that it causes said segments to separate in a direction generally normal to the plane of the loop body when the fastening device is moved so as to bring the stem of the hook into the ramped entry region with said stem being positioned generally and approximately in the plane of the loop body and generally crosswise to the longitudinal axis of the loop body, said separation of the segments causing the normally effectively closed fixed loop end to open to allow the stem of the hook to enter directly into the inner region of the loop.

48. An openable section in the loop as set forth in claim 45, 46, or 47, said openable section being an element of an effectively closed generally loop shaped clip which is adapted to fasten a hook to a linear member when the hook is hooked to the linear member.

49. The fastening device of claim 47 wherein the loop body is made of wire with the two ends of the wire being at that end of the loop body having the two overlapping segments of the fixed loop end and wherein each overlapping segment of the fixed loop end is formed by having the wire from the fixed loop end of each side member of the loop body bent around a generally and approximately 180 degree curved path lying generally and approximately in the plane of the loop body so that, at the end of the curved path, the wire generally overlaps the opposite side member, the wire generally continuing straight for a short distance coming out of the curved path and then generally and approximately reversing direction in a generally sharp bend so that it extends again in the same general direction as the side members before they were bent in the described curved path, the wire continuing generally in that direction until it reaches a point approximately abreast the end of the fixed loop end portion of the loop body, the wire then being generally bent at an angle away from the plane of the loop body on the same side of said plane as its own overlapping segment and then generally coming to its end so as to form a ramped entry region in conjunction with the end of the wire from the opposite side member.

50. The fastening device of claim 47 wherein the side members have surfaces located generally near the overlapping segments, said surfaces contacting and reacting with the stem of the hook when the fastening device is tilted approximately 90 degrees about the longitudinal axis of the loop body during removal of the fastening device from its fastening position, causing the overlapping segments to separate, opening the fixed loop end, and allowing the stem of the hook to be directly withdrawn from the inner region of the loop.

51. The fastening device of claim 50 wherein each overlapping segment, together with its respective side member, basically forms a generally J-shaped structure, the side member being the straight part of the "J" and the ramped entry region being in addition to the described J-shaped structure, and wherein a portion of that part of the overlapping segment corresponding to the end of the curved portion of the "J" is generally bent at an angle away from the plane of the loop body on the same side of said plane as its own overlapping segment to form a ramped exit region for the stem of the hook to facilitate withdrawing said stem of the hook from the inner region of the loop during removal of the fastening device from its fastening position.

52. The fastening device of claim 7 wherein the effectively closed loop has an open section which is so constructed and arranged that the stem of the hook can effectively pass directly into and out of the inner region of the loop through the open section.

53. A section of a loop shaped clip containing an open section as set forth in claim 52 said section of the loop shaped clip being an element of an effectively closed generally loop shaped clip which is adapted to fasten a hook to a linear member when the hook is hooked to the linear member.

54. A device for fastening an object to a generally linear member, said device comprising a hook which is generally and at least indirectly connected to the object, and an effectively closed generally loop shaped clip in which the effective length of the loop portion of the clip is extensible and which is so constructed and arranged that it is adapted to occupy a position with respect to the hook and the linear member, when the hook is hooked to the linear member, such that the clip generally contacts the outside surface of the hook at two points, one generally on each side of the position occupied by the linear member, and the loop lies between said two points on a path which generally passes on the side of the linear member which is opposite to the side closest to the inner surface of the hook.

55. The device of claim 54 wherein the end of the hook is so shaped that the hook incorporates a retaining element for the loop shaped clip.

56. A method for fastening the hook of a hook including device to a generally linear member to which the hook is hooked comprising manipulating a generally loop shaped clip, in which the effective length of the loop is extensible, into a position with respect to the hook and the linear member as set forth in claim 1.

57. A method according to claim 56 wherein, in performing the method, the loop shaped clip is manipulated so that the end of hook passes through the loop of the clip, relatively speaking, the clip is moved so that the loop of the clip passes between the hook and the linear member to position the clip with the rod, of which the hook is formed, passing through the loop of the clip on that side of the linear member generally opposite to the side facing the end of the hook, the clip is manipulated so that its loop passes under the linear member, and further manipulated so that the end of the hook passes through the loop and the clip is manipulated into the described fastening position.

58. A method according to claim 56 wherein the generally loop shaped clip has an openable section in the loop and wherein, in performing the method, the loop is suitably positioned so that the rod, of which the hook is formed, passes through the loop of the clip by manipulating and moving the clip with respect to the hook so that the rod of the hook passes into the loop through the openable section of the loop and the clip is moved into the described fastening position.

59. A method according to claim 56 wherein the generally loop shaped clip has an open section in the loop and wherein, in performing the method, the clip is manipulated and moved with respect to the hook so that the rod, of which the hook is formed, passes into the loop of the clip through the open section of the loop and the clip is moved into the described fastening position.

60. A method for fastening a hook to a linear member comprising hooking the hook to the linear member and installing a generally loop shaped clip, in which the effective length of the loop is extensible, according to claim 56.

61. A method according to claim 60 wherein, in performing the method, the loop shaped clip is first suitably positioned on the hook so that the rod, of which the hook is formed, passes through the loop of the clip, the hook is then hooked to the linear member, and the clip is then moved and manipulated so that the loop of the clip goes under the linear member, the end of the hook goes through the loop, and the clip is moved into the described fastening positions.

62. A method according to claim 56 wherein the generally loop shaped clip has an elastic force producing member which generally urges a reduction in the extension of the effective length of the loop, wherein the clip is positioned so that the rod, of which the hook is formed, passes through the loop of the clip on that side of the linear member generally opposite to the side facing the end of the hook, and wherein, in performing the method, the clip is manipulated so that the effective length of the loop is extended and so that the loop moves under the linear member and further moves so that the end of the hook passes into and through the loop and the clip is raised and released into the described fastening position.

63. A method according to claim 56 or 62 wherein, in performing the method, the generally loop shaped clip is manipulated and moved into a position with respect to the hook and the linear member such that the clip bears upon and is positively supported by the generally curved upper surface of the hook at two spaced-apart points, one on each side of the linear member, and the clip also lies between said two support points on a path which generally passes on the side of the linear member which is opposite to the side closest to the inner surface of the hook, the clip being so constructed, arranged and sized that it is adapted to occupy such a positively interlocking position with respect to the hook and the linear member.

64. A method according to claim 62 wherein the manner in which the clip is manipulated to extend the effective length of the loop and move and release the clip to and into the described fastening position is by grasping and moving structure connected to one part of the clip while another part of the clip is restrained generally by contact with the hook.

65. A method according to claim 62 wherein the manner in which the clip is manipulated so as to extend the effective length of the loop is by grasping each of two parts of the clip which are movable with respect to each other when the effective length of the loop is changed and manipulating and moving said two parts with respect to each other so as to extend the effective length of the loop.

66. A method according to claim 62 wherein the generally loop shaped clip has a movable loop part which allows the loop to be effectively extended in length and wherein the manner in which the clip is manipulated so as to extend the effective length of the loop is by generally pressing together structure connected to the movable loop part and structure connected to the primary clip structure.

* * * * *